US007762289B2

(12) United States Patent
McCulloh et al.

(10) Patent No.: US 7,762,289 B2
(45) Date of Patent: Jul. 27, 2010

(54) METHOD AND RELATED SYSTEM OF FILLING THERAPEUTIC GAS CYLINDERS

(75) Inventors: Kevin G. McCulloh, Simi Valley, CA (US); Alonzo C. Aylsworth, Wildwood, MO (US); Lawrence C. Spector, Austin, TX (US)

(73) Assignee: Respironics, Inc., Murrysville, PA (US)

( * ) Notice: Subject to any disclaimer, the term of this patent is extended or adjusted under 35 U.S.C. 154(b) by 1361 days.

(21) Appl. No.: 11/157,708

(22) Filed: Jun. 21, 2005

(65) Prior Publication Data

US 2006/0283517 A1 Dec. 21, 2006

(51) Int. Cl.
*B65B 57/06* (2006.01)

(52) U.S. Cl. ..... 141/2; 141/18; 141/197; 128/204.18

(58) Field of Classification Search ..... 141/2, 141/4, 18, 83, 94–96, 197; 128/202.22, 204.18, 128/204.19, 204.21, 204.22
See application file for complete search history.

(56) References Cited

U.S. PATENT DOCUMENTS

| | | | | |
|---|---|---|---|---|
| 3,208,574 | A * | 9/1965 | Anson | 141/197 |
| 3,799,218 | A * | 3/1974 | Douglass | 141/18 |
| 4,195,673 | A | 4/1980 | Johnston | |
| 5,628,349 | A * | 5/1997 | Diggins et al. | 141/3 |
| 5,746,806 | A * | 5/1998 | Aylsworth et al. | 95/8 |
| 5,866,803 | A * | 2/1999 | Namba et al. | 73/40.5 R |
| 5,953,682 | A * | 9/1999 | McCarrick et al. | 235/375 |
| 6,473,940 | B1 | 11/2002 | Cooper | |
| 6,720,865 | B1 * | 4/2004 | Forster et al. | 235/375 |
| 6,904,913 | B2 * | 6/2005 | Aylsworth et al. | 128/204.22 |
| 6,994,075 | B2 * | 2/2006 | Penschuck | 123/518 |
| 7,150,280 | B2 * | 12/2006 | Aylsworth et al. | 128/204.22 |
| 2002/0092346 | A1 * | 7/2002 | Niekerk et al. | 73/146.2 |
| 2003/0121555 | A1 * | 7/2003 | Kroupa et al. | 137/636 |
| 2004/0079441 | A1 | 4/2004 | Richey, II et al. | |
| 2005/0000588 | A1 | 1/2005 | Webb et al. | |
| 2005/0061390 | A1 | 3/2005 | Mathis et al. | |
| 2006/0157058 | A1 * | 7/2006 | Aylsworth et al. | 128/204.23 |
| 2008/0084306 | A1 * | 4/2008 | Durtschi et al. | 340/572.1 |

OTHER PUBLICATIONS

International Search Report, International Application No. PCT/US06/22242, dated Jun. 8, 2006.

* cited by examiner

*Primary Examiner*—Gregory L Huson
*Assistant Examiner*—Nicolas A Arnett
(74) *Attorney, Agent, or Firm*—Michael W. Haas

(57) ABSTRACT

A method and related system of filling therapeutic gas cylinders. At least some of the illustrative embodiments are a method comprising determining, by a cylinder fill device, a rated pressure of a therapeutic gas cylinder, and filling the cylinder with the cylinder fill device substantially to the rated pressure.

5 Claims, 4 Drawing Sheets

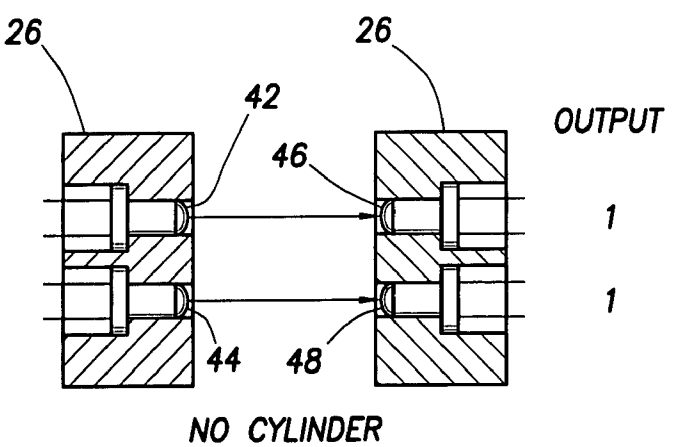
FIG.4A
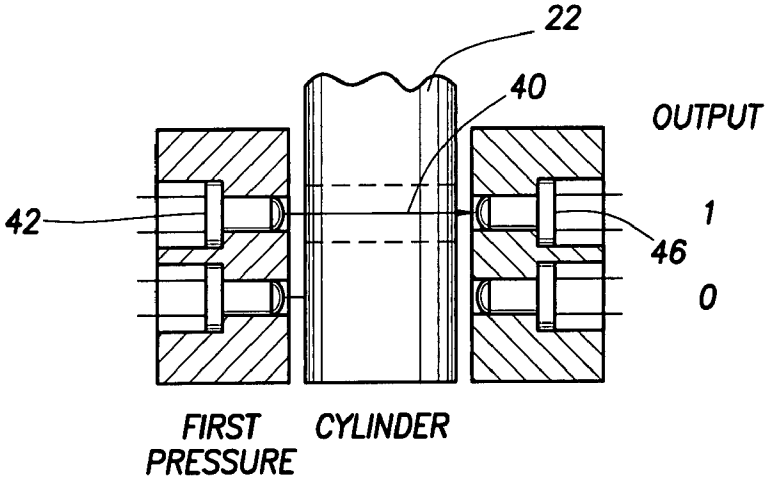
FIG.4C
FIG.4B
FIG.4D

METHOD AND RELATED SYSTEM OF FILLING THERAPEUTIC GAS CYLINDERS

CROSS-REFERENCE TO RELATED APPLICATIONS

None.

STATEMENT REGARDING FEDERALLY SPONSORED RESEARCH OR DEVELOPMENT

Not applicable.

BACKGROUND

1. Field of the Invention

Various embodiments of the invention are directed to filling of portable therapeutic gas cylinders. More particularly, various embodiments of the invention are directed to determining, by a cylinder fill device, the rated pressure of a therapeutic gas cylinder.

2. Background

Patients with respiratory difficulties that are required to breathe enriched oxygen may be ambulatory by using a portable oxygen cylinders. Portable oxygen cylinders may range in size from cylinders that require a two-wheel dolly to be moved around, to those cylinders that fit neatly within a carrying case the size of a large purse, and also may be worn in a fashion similar to a back pack.

One of the factors that determines how long a portable cylinder can supply oxygen to a patient is the volume of the cylinder. The larger the volume, the larger the size of the cylinder. Another factor that determines how long a portable cylinder can supply oxygen to a patient is the pressure that the portable cylinder can withstand. If the patient has a choice between two portable cylinders having the same volume, yet one portable cylinder may be filled to a pressure of 3,000 pounds per square inch (psi), and a second portable cylinder can be filled only to 2,000 psi, the higher pressure cylinder in this case (and assuming the same volumes) holds more oxygen.

Some patients that utilize portable cylinders gas have within their homes devices that can fill or refill the portable cylinders. While home-based devices may be capable of filling cylinders with differing fill pressures, discerning the rated pressure of an attached cylinder by a home-based system is difficult.

SUMMARY

The problems noted above are solved in large part by a method and related system of filling therapeutic gas cylinders. At least some of the illustrative embodiments are a method comprising determining, by a cylinder fill device, a rated pressure of a therapeutic gas cylinder, and filling the cylinder with the cylinder fill device substantially to the rated pressure.

Other illustrative embodiments may be a cylinder filling system comprising a source of therapeutic gas, a cylinder fill connector fluidly coupled to the source of therapeutic gas, and configured to couple to a therapeutic gas cylinder, and a pressure rating detection system associated with the cylinder fill connector, wherein the pressure rating detection system is configured to determine whether the therapeutic gas cylinder is rated for a first pressure or a second pressure, the second pressure higher than the first pressure. The cylinder filling system is configured to fill the therapeutic gas cylinder with therapeutic gas to substantially the first pressure if the therapeutic gas cylinder is rated for the first pressure, and to fill the therapeutic gas cylinder to the second pressure if the therapeutic gas cylinder is rated for the second pressure.

Yet still other illustrative embodiments may be an apparatus comprising a valve body comprising an internal chamber, a threaded connection coupled to the valve body and configured to fluidly couple the internal chamber to a therapeutic gas cylinder, a fill port aperture through the valve body into the internal chamber, and a means for identifying a pressure rating of the therapeutic gas cylinder to which the apparatus is configured to attach, the means for identifying proximate to or associated with the valve body.

The disclosed devices and methods comprise a combination of features and advantages which enable it to overcome the deficiencies of the prior art devices. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which:

FIG. 4 (comprising FIGS. 4A-4D) illustrate a pressure rating detection system in accordance with embodiments of the invention;

NOTATION AND NOMENCLATURE

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

References to pressure in this specification are to gauge pressure. Thus, a reference to a therapeutic gas cylinder as having a rated pressure of 3000 pounds per square inch (PSI)

are gauge readings, not absolute pressure readings, and thus should be read as PSI gauge or PSIG.

Figure 1:
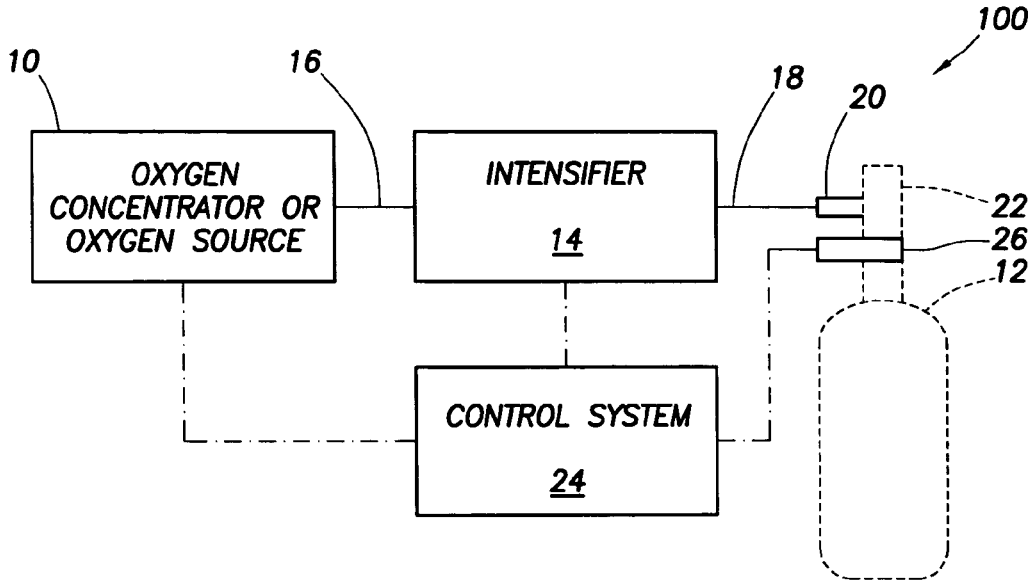
FIG. 1 shows a cylinder fill device in accordance with embodiments of the invention.

Fluid connections between devices are illustrated in FIG. 1 by way of solid lines, and electrical connections are illustrated by way of dash-dot-dash lines, so as not to unduly complicate the specification.

DETAILED DESCRIPTION OF THE PREFERRED EMBODIMENTS

FIG. 1 illustrates a system for filling portable cylinders, also known as a cylinder fill device, in accordance with embodiments of the invention. Devices such as illustrated in FIG. 1 may be used, for example, in a patient's home to fill therapeutic gas cylinders for ambulatory use. In particular, the system 100 may comprise an oxygen source or oxygen concentrator 10. The oxygen concentrator 10 may be any suitable device for increasing the oxygen content of therapeutic gas delivered to a patient. For example, the oxygen concentrator 10 may be a pressure swing absorption (PSA) system having a plurality of molecular sieve beds operated in a parallel relationship. Atmospheric air, possibly drawn through an air inlet, may be drawn or pumped through a first molecular sieve bed where nitrogen molecules are trapped, and where oxygen and argon molecules flow through substantially unimpeded. By removing the nitrogen from the atmospheric air, the concentration of oxygen in the gas exiting the sieve bed may be relatively high, e.g. 90% oxygen or more. While one molecular sieve bed acts to filter nitrogen, a second molecular sieve bed may use a portion of the therapeutic gas as a back-flow gas to flush trapped nitrogen to atmosphere, and prepare the bed for future operation. While a pressure swing absorption system may be used in some embodiments, any device or system capable of making or delivering therapeutic gas may be used, and thus reference herein to oxygen concentrator 10 should not be construed to limit the oxygen source to just a concentrator.

Gas exiting an illustrative pressure swing absorption system may be referred to as oxygen-enriched gas or just enriched gas. The term therapeutic gas may encompass not only oxygen-enriched gas exiting a pressure swing absorption system, but also gas having a therapeutic oxygen content from other sources, such as from liquid oxygen sources, and therapeutic gas having other constituents.

In accordance with at least some embodiments, the pressure of the gas exiting the oxygen concentrator 10 may be on the order of 5-40 PSI. In order to force therapeutic gas into a portable cylinder, for example therapeutic gas cylinder 12 (shown in dashed lines as it is not necessarily a part of the cylinder fill device), the pressure of the therapeutic gas may need to be increased. Thus, in some embodiments, therapeutic gas exiting the oxygen concentrator 10 may be supplied to an intensifier 14 by way of conduit 16. Intensifier 14 may be any device which is capable of taking the therapeutic gas at a first pressure and increasing the pressure. Intensifier 14 may be, in effect, a compressor of any available or after-developed type. In accordance with embodiments of the invention, the intensifier 14 increases the gas pressure to a plurality of possible pressures depending on the rated pressure of an attached therapeutic gas cylinder 12. High pressure therapeutic gas exiting the intensifier 14 may flow into the illustrative cylinder 12 by way of conduit 18 and cylinder fill connector 20. Cylinder fill connector 20 may be any suitable device for coupling to the fill port on a post valve 22 of a therapeutic gas cylinder 12.

The intensifier 14, having the ability to selectively increase the therapeutic gas pressure (e.g., 2200PSI (to fill a therapeutic gas cylinder rated for 2000PSI) or 3200PSI (to fill a therapeutic gas cylinder rated for 3000 PSI)), may take many forms. In some embodiments, the intensifier 14 may have multiple stages of compression, with each stage selectively controllable, such as by control system 24. In alternative embodiments, the intensifier 14 may be implemented by way of a variable speed motor coupled to a compression device, and the creation of different compressed therapeutic gas stream pressures may be controlled by selecting a particular speed of the variable speed motor, again possibly by control system 24. In yet still other embodiments, the intensifier 14 may comprise separate compressors, each having a different outlet pressure, and achieving the desired outlet pressure may be accomplished by selectively utilizing one of the compressors.

Still referring to FIG. 1, the cylinder fill device 100 in accordance with embodiments of the invention also comprises a pressure rating detection system 26 that electrically couples to control system 24 and in some embodiments is located proximate to post valve 22 of cylinder 12. The pressure rating detection system, possibly in combination with the control system 24, determines the rated pressure of the therapeutic gas cylinder 12 so that the cylinder fill device 100 can fill the therapeutic gas cylinder 12 to an appropriate pressure.

Figure 2:
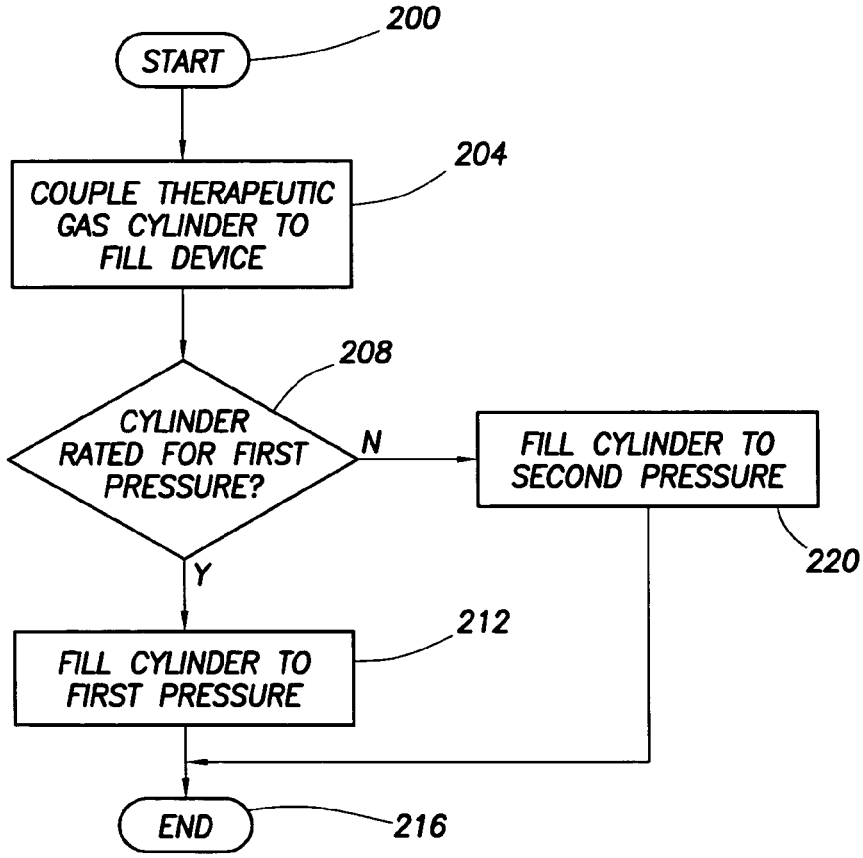
FIG. 2 illustrates a method that may be implemented in accordance with embodiments of the invention.

FIG. 2 illustrates a method that may be implemented in accordance with embodiments of the invention that selectively fills to two different pressures. In particular, the process may start (block 200) and proceed to coupling a therapeutic gas cylinder to a cylinder fill device (204). Thereafter, a determination is made by the cylinder fill device whether the cylinder is rated for a first pressure (block 208). If the cylinder is rated for the first pressure, then the cylinder is filled to the first pressure (block 212) and the process ends (block 216). On the other hand, if the cylinder is rated for other than the first pressure, then the cylinder fill device fills the cylinder to a second pressure (block 220), and the illustrative process ends (block 216). While in some embodiments the illustrative cylinder fill device 100 has the capability of selectively filling to two different pressures, in further embodiments the cylinder fill device 100 may have the capability of filling to any number of desired fill pressures without departing from the scope and spirit of the invention.

Figure 3A:
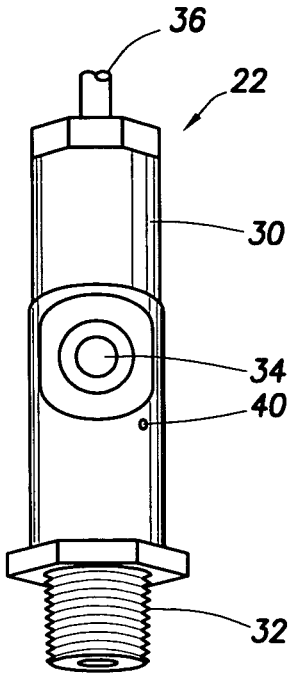
FIG. 3 (comprising FIGS. 3A and 3B) illustrate a post valve in accordance with embodiments of the invention.
Figure 3B:
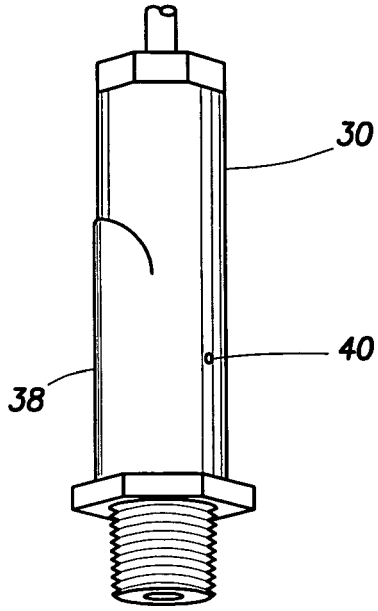

FIGS. 3A and 3B show a post valve in accordance with at least some embodiments of the invention. As alluded to with respect to FIG. 1, a post valve 22 is configured to mechanically couple to a therapeutic gas cylinder 12. The post valve 22 may serve several functions, such as acting as a valve with respect to contents flowing into or out of the therapeutic gas cylinder 12, to act as a fill port to fill the therapeutic gas cylinder 12, and possibly to act as a patient port so that therapeutic gas may be provided to a patient. A post valve 22 in accordance with embodiments of the invention also comprises a valve body 30 and a threaded connector 32 coupled to the valve body 30. The threaded connector 32 is configured to fluidly couple an internal chamber of the post valve (the internal chamber visible through the fill port aperture 34) to the therapeutic gas cylinder (not specifically shown in FIG. 3A). A post valve may also comprise a stem 36 that actuates a valve (not specifically shown) within the internal chamber, and such valve may act to be the main supply control valve with regard to therapeutic gas in an attached therapeutic gas cylinder. Referring to FIG. 3B, a portion of the valve body 30 is substantially cylindrical, and yet another portion of the valve body 30 is a flat surface 38. Referring to FIGS. 3A and 3B somewhat simultaneously, the flat surface 38 allows a cylinder fill connector (such as cylinder fill connector 20 of FIG. 1) to fluidly couple to the aperture 34, possibly using a gasket or O-ring to ensure a proper seal.

Still referring to FIGS. 3A and 3B, a post valve in accordance with some embodiments of the invention also comprises an identification aperture 40, which aperture may be drilled through the valve body. However, unlike the aperture 34 which provides fluid communication to the internal chamber of the post valve and therefore the therapeutic gas cylinder, the identification aperture 40 is not in fluid communication with the internal chamber, and instead may be merely drilled through a portion of the valve body 30. The illustrative identification aperture shown in FIG. 3A extends through the valve body (again without being in fluid communication to the internal chamber of the valve body) and may exit on a back portion of the valve body, such as illustrated in FIG. 3B. In accordance with at least some embodiments of the invention, the identification aperture may be detected by the pressure rating detection system 26 (of FIG. 1).

Referring to FIG. 4A, in some embodiments the pressure rating detection system 26 may comprise one or more sources of high frequency electromagnetic radiation, such as a first and second light-emitting diodes 42 and 44, respectively. The pressure rating detection system in accordance with these embodiments of the invention may also comprise a first and second detectors, such as a first and second detectors 46 and 48, designed and configured to detect the light emitted by the first and second light-emitting diodes 42 and 44, respectively. Any suitable wavelength of light may be used, and in some embodiments the light-emitting diodes 42 and 44 may generate infrared spectrum light. As illustrated in FIG. 4A, the first detector 46 is configured to receive light from the first LED 42, and the second detector 48 is configured to receive light from LED 44. Each of these detectors and LEDs is preferably coupled to the control system 24 (FIG. 1). When no cylinder is coupled to the cylinder fill device 100, in the illustrative embodiments of FIG. 4 each detector 46 and 48 detects light from its respective LED, and thus the control system 24 may detect a Boolean value of "11." In accordance with embodiments of the invention, such an output is indicative of no cylinder being present and/or attached to the cylinder fill device. FIG. 4B illustrates a situation where a post valve 50 may be coupled to the cylinder fill device, and a portion of that post valve being between the LEDs 42, 44 and the detectors 46, 48. In this case, however, the post valve 50 does not comprise an identification aperture, and thus the illustrative system generates an output of "00," indicating the cylinder to which the post valve is attached is not configured for use with the current system.

FIG. 4C illustrates a situation where a post valve 22 constructed in accordance with embodiments of the invention is coupled to the cylinder fill device 100, and thus a portion of the post valve lies between the LEDs 42, 44 and the detectors 46, 48. In the illustrative case of FIG. 4C, however, the identification aperture is present in the post valve 22, and thus LED/detector pair 42/46 sense light through the valve body of the post valve. In this illustrative case, the control system 24 may detect an output from the pressure rating detection system 26 of "10," thus indicating that the cylinder is rated for a first predetermined pressure.

FIG. 4D illustrates a situation where a post valve 22 constructed in accordance with embodiments of the invention has an identification aperture 40, yet the identification aperture is in a physically different location than that illustrated in FIG. 4C, and thus the LED/detector pair 44/48 senses light through the valve body of the post valve. In this illustrative case, the control system 24 may detect an output from the pressure rating detection system 26 of "01," and such an output may signify that the therapeutic gas cylinder 12 coupled to the cylinder fill device 100 is rated for a second pressure. Returning briefly to the illustrative method of FIG. 2, the determination of whether the cylinder is rated for a first pressure (at block 208) may therefore, in accordance with at least some embodiments, be a determination of the output signal generated by the pressure rating detection system comprising LEDs 42, 44 and detectors 46, 48. Although FIG. 4 illustrates a system comprising only two detectors 46, 48 and two respective LEDs 42, 44, any number of detectors and LEDs may be used such that the pressure rating detection system in combination with the control system 24 may be capable of discerning three or more different rated pressures of cylinders to which the post valves 22 attach, and further the cylinder fill device 100 may also have the capability of filling selectively to any of the rated pressures detected.

Figure 5:
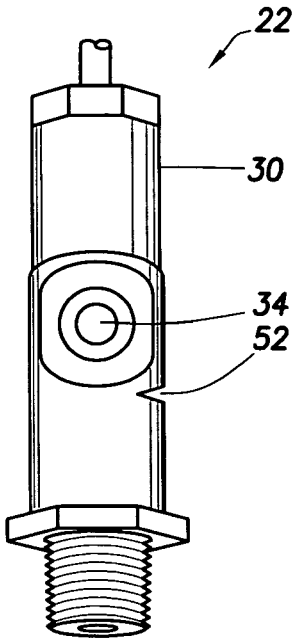
FIG. 5 illustrates a post valve in accordance with alternative embodiments of the invention.

FIG. 5 illustrates alternative embodiments of the post valve 22 that utilize a groove 52 across the valve body 30 as an alternative to the identification aperture 40 illustrated in FIGS. 3A and 3B. Operation of embodiments utilizing a groove 52 rather than the identification aperture 40 may work substantially as discussed with respect to FIGS. 4A-4D. In the embodiments discussed with respect to FIGS. 3A and 3B and FIG. 5, the identification aperture 40 and/or groove 52 are shown to extend substantially perpendicular to the flat surface 38 (FIG. 3B). However, in yet further alternative embodiments the identification aperture 40 and the identification groove 52 may run parallel to a plane defined by the flat surface 38; that is, across the flat surface 38 rather than perpendicular to the flat surface 38. Moreover, the identification aperture 40 or groove 52 may be above or below the fill aperture 34 without departing from the scope and spirit of the invention.

Figure 6:
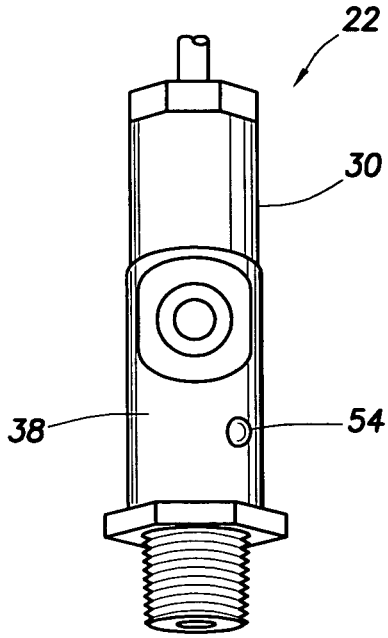
FIG. 6 illustrates a post valve in accordance with alternative embodiments of the invention.
Figure 7:
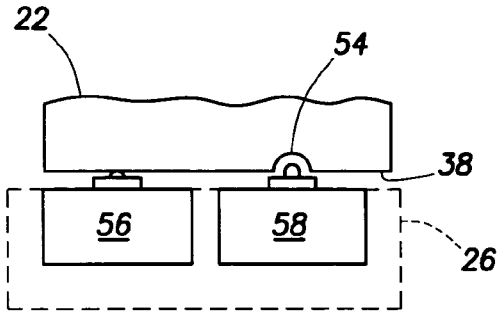
FIG. 7 illustrates a pressure rating detection system in accordance with alternative embodiments of the invention.

FIG. 6 illustrates alternative embodiments of the post valve 22 that uses an indention or dimple 54 on the flat surface 38. In these embodiments, either the number of dimples and/or the placement of the dimples on the flat surface 38 may be indicative of the pressure rating. In embodiments using a dimple 54 as the attribute that indicates pressure rating, the pressure rating detection system 26 (FIG. 1) may, for example, mechanically detect the presence of the dimple 54 by way of the micro-switches, such as micro-switches manufactured by Cherry Switch, which are available from Digi-Key as part numbers CH603-ND. FIG. 7 illustrates embodiments where the pressure rating detection system 26 comprises a first micro-switch 56 and a second micro-switch 58. FIG. 7 also shows the flat surface 38 of the post valve 22, and in particular how the presence of the dimple 54 may be detected by a lack of actuation of a switch. In the particular case illustrated in FIG. 7, micro-switch 58 is not actuated while micro-switch 56 is actuated, and thus an illustrative output of the pressure rating detection system 26 may be a "10." Much like the pattern illustrated in FIGS. 4A through 4D, an output of "10" may indicate a first pressure. The other situations illustrated in FIGS. 4A through 4D regarding outputs are equally applicable to the embodiments illustrated in FIG. 7. While FIG. 6 shows the illustrative dimple 54 on the flat surface 38, the illustrative dimple may be placed at any location on the valve body 30 without departing from the scope and spirit of the invention.

Figure 8:
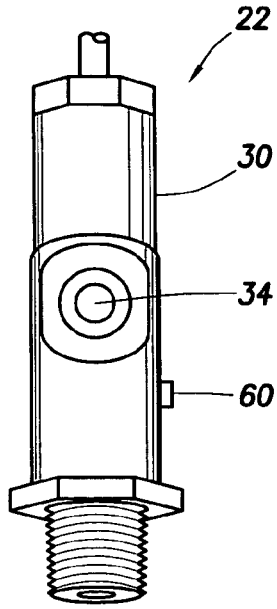
FIG. 8 illustrates a post valve in accordance with alternative embodiments of the invention.
Figure 9:
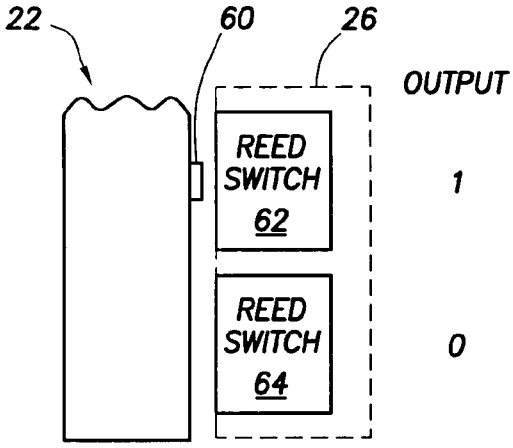
FIG. 9 illustrates a pressure rating detection system in accordance with alternative embodiments of the invention.

FIG. 8 shows yet still further alternative embodiments of the post valve 22. In particular, post valve 22 in accordance with alternative embodiments of the invention may have coupled thereto a magnet 60. In accordance with these embodiments, the presence, absence and/or number of magnets affixed to the valve body 30 are indicative of the pressure rating of the therapeutic gas cylinder to which the post valve attaches. As illustrated in FIG. 9, in embodiments using one or more magnets mechanically coupled to the post valve 22, the pressure rating detection system 26 may comprise a first and second reed switch 62 and 64, respectively, positioned within and by the pressure rating detection system 26 such that a magnet 60 coupled to the post valve 22 actuates the reed switch. The reed switches may be, for example, reed switches manufactured by Cherry Switch, which are available from Digi-Key as part numbers CH402-ND. In the illustrative example of FIG. 9, reed switch 62 would be activated, while reed switch 64 would not, and thus an output of the illustrative pressure rating detection system 26 using reed switches may be "10." This illustrative situation may be similar to that of FIG. 4C, indicating that the cylinder to which the post valve 22 attaches is rated for the first pressure. The other illustrative outputs are likewise applicable to the situation illustrated in FIG. 9, except that some other means may be needed to detect the presence of the therapeutic gas cylinder in general.

Although FIG. 8 illustrates the magnet 60 coupled to an outer surface of the post valve 30 below the fill aperture 34, the one or more magnets 60 may be located at any convenient location on the post valve 22. Moreover, the one or more magnets may also be countersunk within the material forming the valve body 30 (yet not extending to the internal chamber), and still be within the scope and spirit of the invention.

Figure 10:
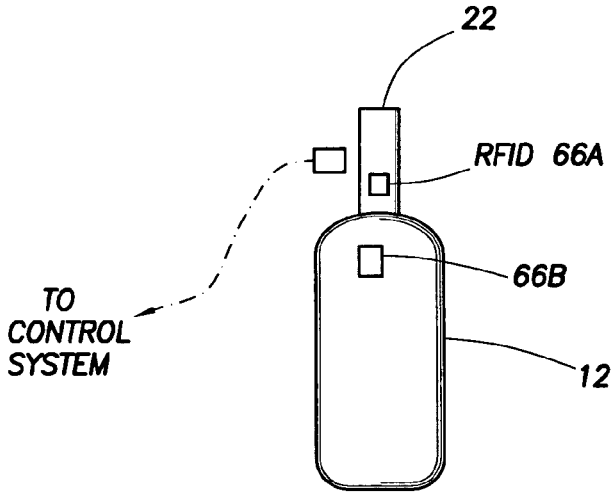
FIG. 10 illustrates a pressure rating detection system in accordance with embodiments of the invention.

FIG. 10 illustrates yet still further alternative embodiments where the pressure rating of the therapeutic gas cylinder 12 to which the post valve 22 attaches is identified by way of a radio frequency identification (RFID) tag 66 coupled to the post valve. Alternatively, the RFID tag may be coupled to an outer surface of the therapeutic gas cylinder 12 itself. In these illustrative embodiments, the RFID tag 66 may be any currently available or after-developed RFID tag, such as devices available from CopyTag Ltd. of the United Kingdom, having part numbers CTTC4 or CRRC1. In embodiments utilizing RFID tags as the mechanism by which to identify the pressure rating of the therapeutic gas cylinder 12, the pressure rating detection system 26 may thus comprise an RFID reader, such as devices available from CopyTag having a part number CTCR1. Using RFID tags and RFID readers, the pressure rating detection system 26 need not be proximate post valve 22, as the RFID tags and RFID readers may be operational even when those devices are several inches or feet apart.

Figure 11:
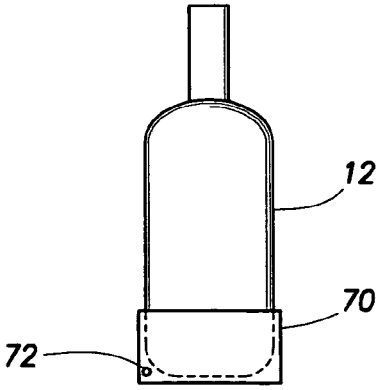
FIG. 11 illustrates alternative embodiments of the invention.

FIG. 11 illustrate still further alternative embodiments where the pressure rating of the therapeutic gas cylinder 12 is identified by way of an attribute of a cylinder base 70. In particular, at the retail level, some therapeutic gas cylinders include a cylinder base 70, which may help stabilize the therapeutic gas cylinder 12 when standing in the upright position. In addition to, or in place of, stabilizing the cylinder, an attribute of the cylinder base 70 may be used to identify the pressure rating of the therapeutic gas cylinder to which the cylinder base 70 attaches. For example, FIG. 11 illustrates the attribute as an aperture 72 through a portion of the cylinder base 70. Though the aperture 72 is illustrated to be on a side, the aperture may be through any viable portion of the cylinder base without departing from the scope and spirit of the invention. While the aperture 72 is illustrative of the attribute, any attribute of the cylinder base 70 may be used, such as grooves, dimples, protrusions or tabs. Moreover, the attribute may be the presence, absence and/or location of one more magnets coupled to or within the cylinder base 70. Detection of the attributes of the cylinder base 70 of FIG. 11 may be accomplished with their respective pressure rating detecting system discussed with respect to the other embodiments, but positioned proximate to the cylinder base 70 when the therapeutic gas cylinder is coupled to a cylinder filling system.

The above discussion is meant to be illustrative of the principles and various embodiments of the present invention. Numerous variations and modifications will become apparent to those skilled in the art once the above disclosure is fully appreciated. For example, many of the embodiments discussed above use the presence and/or location of an attribute of a device that couples the therapeutic gas cylinder as an indication of rated pressure; however, the absence of a particular attribute too may be indicative of rated pressure. Moreover, any It is intended that the following claims be interpreted to embrace all such variations and modifications.

What is claimed is:

1. A method of filling a therapeutic gas cylinder, the method comprising:

determining, by a cylinder fill device, a rated pressure of the therapeutic gas cylinder by detecting the presence of one or more apertures, dimples, grooves, or magnets associated with a post valve coupled to the therapeutic gas cylinder; and filling the cylinder with the cylinder fill device to the rated pressure.

2. The method as defined in claim 1, wherein detecting the presence of one or more apertures, dimples, grooves, or magnets associated with a post valve coupled to the therapeutic gas cylinder comprises detecting one or more apertures through the post valve.

3. The method as defined in claim 1, wherein detecting the presence of one or more apertures, dimples, grooves, or magnets associated with a post valve coupled to the therapeutic gas cylinder comprises detecting one or more dimples on the post valve.

4. The method as defined in claim 1, wherein detecting the presence of one or more apertures, dimples, grooves, or magnets associated with a post valve coupled to the therapeutic gas cylinder comprises detecting one or more grooves on the post valve.

5. The method as defined in claim 1, wherein detecting the presence of one or more apertures, dimples, grooves, or magnets associated with a post valve coupled to the therapeutic gas cylinder comprises detecting one or more magnets coupled to the post valve.

* * * * *